US005363609A

United States Patent [19]

Hancovsky

[11] Patent Number: 5,363,609

[45] Date of Patent: Nov. 15, 1994

[54] COMBINED STONE AND BRONZE UPRIGHT MONUMENT

[75] Inventor: John P. Hancovsky, McMurray, Pa.

[73] Assignee: Matthews International Corporation, Pittsburgh, Pa.

[21] Appl. No.: 44,376

[22] Filed: Apr. 7, 1993

[51] Int. Cl.[5] ..... E01F 9/02

[52] U.S. Cl. ..... 52/103

[58] Field of Search ..... 62/103; 52/103

[56] References Cited

U.S. PATENT DOCUMENTS 1,843,602 2/1936 Holmes ..... 52/103

3,477,181 11/1969 Robison ..... 52/103

*Primary Examiner*—Carl D. Friedman

*Assistant Examiner*—Christopher Todd Kent

*Attorney, Agent, or Firm*—Webb Ziesenheim Bruening Logsdon Orkin & Hanson

[57] ABSTRACT

An upright grave monument includes a stone base with a pair of spaced-apart vertical stone posts attached to the base. At least one vertically positioned metal panel, preferably of bronze, bearing memorial indicia of the deceased is attached to the posts. A horizontal stone member may also be provided attached to the top of the vertical posts.

19 Claims, 8 Drawing Sheets

COMBINED STONE AND BRONZE UPRIGHT MONUMENT

BACKGROUND OF THE INVENTION

1. Field of the Invention

This invention relates generally to memorials or monuments, and, more particularly, to upright grave monuments.

2. Description of the Prior Art

A grave monument memorializes the burial site of one or more individuals and typically indicates the name, dates of birth and death of the deceased and may also include an epitaph in the form of a memorial prayer or like verse. Grave monuments vary in size and design but typically are made of stone when configured in a vertical or so-called upright orientation. It is also conventional to provide a wider headstone to memorialize the burial site of a married couple, for example. Granite has long been a preferred stone because of its appearance, availability and its natural ability to withstand outdoor elements over a long period of time. A conventional upright grave monument of granite typically consists of a horizontally extending granite base, which supports a vertical die portion, also of granite. The vertical die portion usually carries memorial indicia relating to the deceased which is cut into the granite die by sand blasting or by chisel carving.

Conventional upright stone monuments are usually shipped in pieces and assembled at the grave site due to the great weight of the stone segments and the difficulty of transporting an assembled monument. Assembling a stone monument at the grave site is oftentimes difficult due to the weight of the stone segments, grave site topography and harsh weather conditions which are encountered from time to time. It is also observed that prior upright stone monuments tend to be similar in physical appearance, lending a sameness to all adjacent grave sites. Rather than distinguishing individual grave sites, conventional stone memorials have achieved a somewhat opposite result.

Metal memorials in the form of a horizontal bronze plate or plaque mounted on a horizontal stone base have also been used to mark grave sites in certain cemeteries. Such horizontal bronze memorials are even less distinctive than the upright stone monuments, although the bronze metal offers an aesthetically pleasing appearance.

The present invention provides a combined stone and metal upright memorial grave monument which is placed at the grave site in a fully assembled state without the need for additional assembly, attendant labor or expense. The monument of the present invention is also substantially lighter than a comparable all-stone monument and, therefore, less expensive to transport and easier to handle and install than conventional monuments. The present invention also provides a durable, upright monument constructed of stone and metal, which is aesthetically pleasing and appropriate while being distinctive in appearance compared with prior stone or metal monuments.

SUMMARY OF THE INVENTION

Briefly stated, the present invention is directed to an upright monument and includes a horizontally extending stone base with a pair of spaced-apart, vertically extending stone posts attached to the base. A vertically oriented, upright metal panel, which bears indicia of the deceased, is positioned between the posts. The upright metal panel is attached at opposed edge portions to the vertical posts. In one presently preferred embodiment, a top stone member horizontally extends above the metal plate and is attached to the pair of spaced-apart stone posts to complete the assembly. The metal panels are cast from aluminum or bronze, more preferably, bronze.

The upright metal panel, in one aspect of the invention, is preferably formed by a pair of parallel, spaced-apart, cast metal panels, each of which have outwardly extending, offset flanges on opposed lateral edges. Each stone post has a vertical groove formed therein to mountingly receive the offset flanges of the bronze panels. At least one of the metal panels, such as the front panel, contains indicia relating to the deceased thereon. All of the indicia may be cast in the panel, or a portion of the indicia, such as the date of death, may be applied to the panel in the form of a separately formed scroll piece attached to the panel by screws or adhesives, for example. The rear metal panel may contain one of several standard epitaphs in the form of passages from scripture, a prayer and/or verse or it may contain a personalized epitaph cast directly in the panel.

In a second embodiment of the present invention, the metal panels are joined along their upper edges and diverge outwardly toward the stone base, in the shape of an "A" when viewed in side, cross section. Preferably, the angle formed between the panels is between 10°–15°, and, more preferably, the angle is about 12°. An elongated metal cap or channel horizontally extends along the joined top edges of the panels between the vertical posts.

In both of the above-described embodiments, a thin layer of epoxy resin is applied in the grooves of each vertical post to secure the metal panels therein. Silicone caulking is then applied in the joints between the metal panels and the respective vertical posts to prevent water penetration into the epoxy joints. Additionally, epoxy, along with a steel pin, is employed to secure each stone post to the stone base. A plurality of thin spacer elements of a plastic material is placed beneath the vertical posts to provide a gap between the base and posts to prevent the epoxy from being squeezed out of the joint. Silicone caulking is also employed to fill any voids which may be present in the joints between the base and the posts.

The present invention may also include one or more containers in the form of a flower vase, memorial candle holder, or the like, secured to the base by a threaded stud, for example. The container may be made from metal, glass, plastic and/or stone.

These, as well as other advantages and features of the present invention, will become more apparent when reference is made to the accompanying drawings taken with the following detailed description.

DETAILED DESCRIPTION OF THE INVENTION

Figure 2:
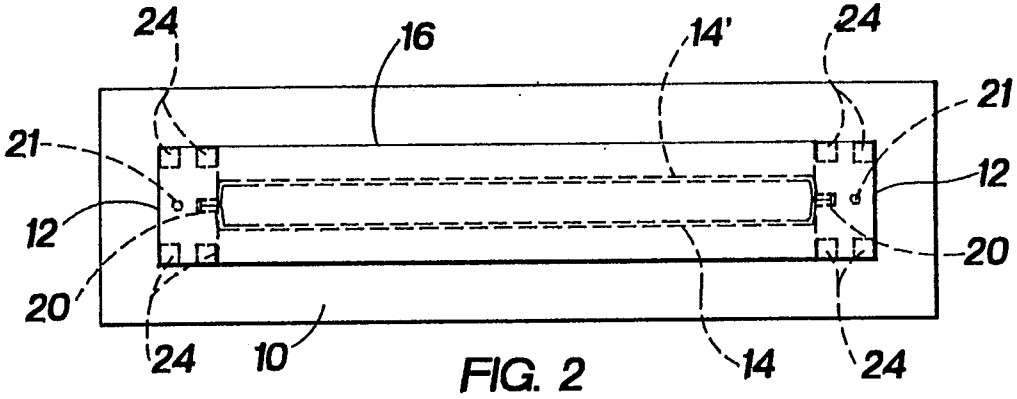
FIG. 2 is a top plan view of the monument of FIG. 1.
Figure 1:
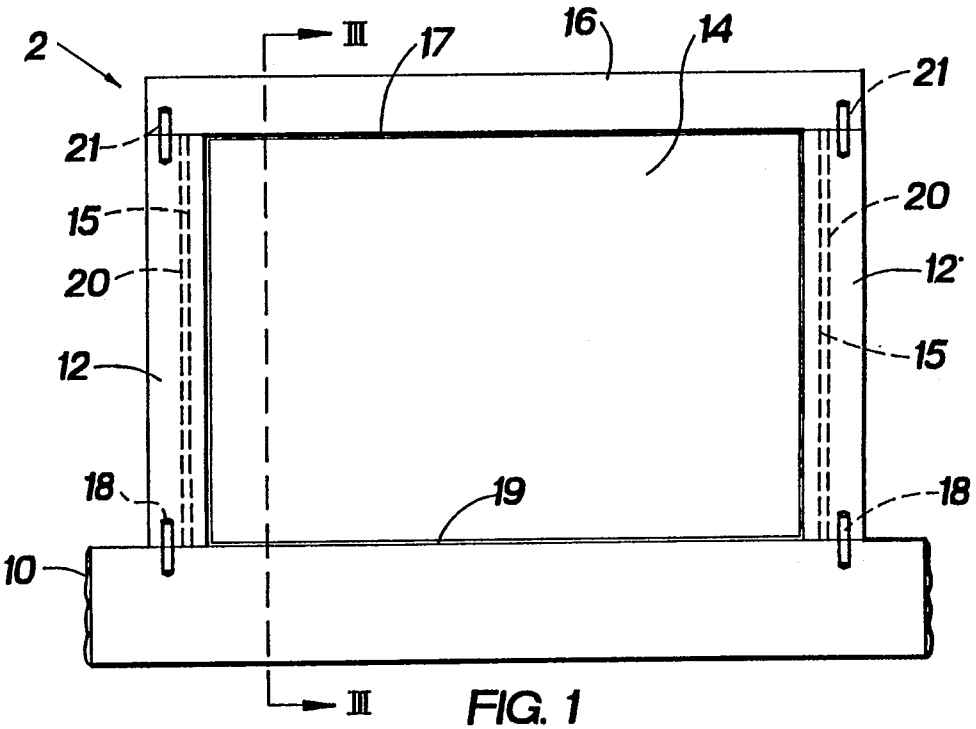
FIG. 1 is a front elevation view of a grave monument of the present invention.

One presently preferred embodiment of an upright grave monument of the present invention, designated generally by reference numeral 2, is depicted in FIGS. 1–5. The monument 2 has a horizontal base 10 and two spaced-apart vertical posts 12 attached to the base. The base 10 and posts 12 are generally rectangular in shape and made of stone, preferably granite. Each post 12 is secured to the base 10 by a steel pin 18, which extends vertically out of the base into the vertical post 12, received within aligned pre-drilled holes formed in the posts and in the base. Epoxy is also applied to the joints as will be explained in greater detail hereinafter.

Each of the vertical posts 12 also has a receiving groove 20 vertically formed along one side thereof. The grooves 20 are formed by sand blasting the stone post in a known manner. Metal panels 14 and 14' of cast bronze or aluminum have outwardly extending, offset flanges 15 and 15', respectively, formed on opposed lateral sides thereof. Presently, cast bronze is the preferred metal for the panels because of its appearance. The lateral flanges 15 and 15' are fitted into the vertical receiving grooves 20 of each of the posts 12 whereby each metal panel 14, 14' is firmly held in place by the vertical posts.

Figure 3A:
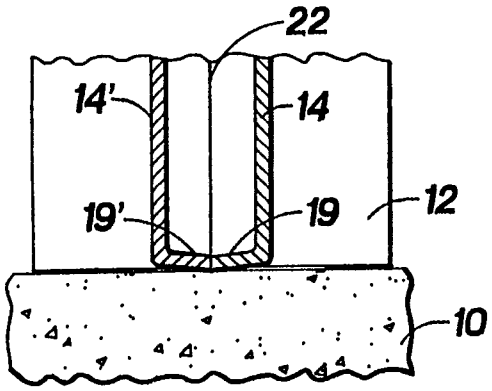
FIG. 3A is an enlarged view of a lower area of the cross section depicted in FIG. 3.
Figure 3:
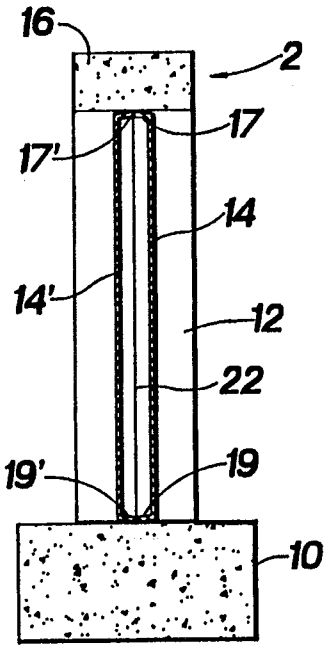
FIG. 3 is a cross sectional side view of the monument taken along line III—III of FIG. 1.
Figure 4:
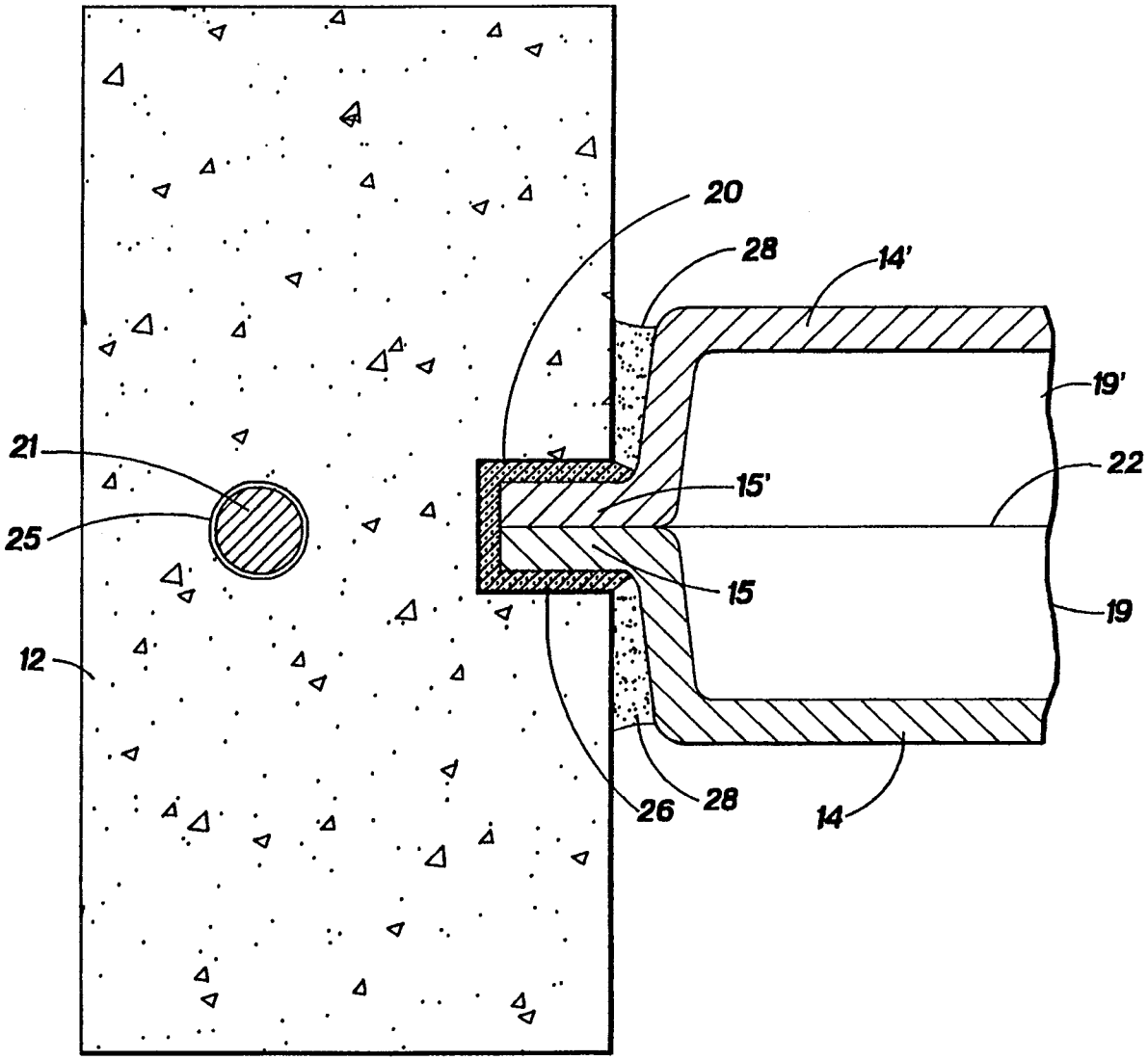
FIG. 4 is an enlarged, partially fragmented, cross sectional top plan view taken along line IV—IV of FIG. 1.

As best seen in FIG. 4, the offset flanges 15, 15' of the metal panels 14, 14', respectively, bear directly against one another within the receiving groove 20 while the planar surfaces of the metal panels 14, 14' reside in a spaced-apart and parallel relationship. The spaced-apart, parallel relationship is provided by the offset flanges 15, 15' which extend inwardly a distance of about 1 inch from the outer surfaces of the respective planar panels 14, 14'. If desired, the flanges 15, 15' may be welded together in spots, although it is not deemed necessary. When assembled according to the embodiment of FIGS. 1–5, the metal panels 14, 14' define an overall panel thickness of about 2 ½ inches, measured from respective outside surfaces. The top sides 17, 17' and bottom sides 19, 19' of the metal panels 14, 14', respectively, are also formed inwardly about 1 inch at about a 90° angle such that the edges bear against one another along a joint line 22 which is also common with the bearing surfaces of the offset flanges 15, 15' as seen in FIGS. 3A and 4. It will thus be appreciated that the metal panels when mounted in the monument 2 give the appearance of a solid, monolithic piece of cast metal of considerable thickness which is aesthetically pleasing, but in reality is relatively lighter in weight and less costly than a solid casting of the same thickness.

A horizontal top member 16, made of stone, preferably granite, extends across the monument 2 and is secured to the top of each vertical post 12 by a steel pin 21 and epoxy. As seen in greater detail in FIG. 4, the holes 25 formed in each of the granite posts 12, base 10 and top horizontal member 16 are drilled slightly larger in diameter than the steel pins 18 and 21. By way of example, the steel pins are preferably ½ inch in diameter and three inches long. Epoxy resin is placed in the drilled holes 25 prior to placement of the pins. In setting the posts 12 on the base 10, four spacer elements 24 are preferably placed at the bottom corners of each post, as shown in FIG. 2, and in the enlarged view of FIG. 9. The spacers 24 are preferably made of a plastic material such as polyethylene and are typically 1 inch square by 1/16 inch thick to provide a gap of similar dimension between the bottom surface of each of the posts 12 and the base 10 to prevent the epoxy, which is also applied along the bottom of the posts, from being squeezed out of the joint interface.

An epoxy joint 26, as depicted in FIG. 4, is formed in each of the vertical grooves 20 to further secure the flanges 15, 15' of the bronze panels therein. Each groove 20 is made slightly wider than the thickness of the joined flanges 15, 15' to allow for ease of assembly and for retention of epoxy therein. By way of example, a groove 20 having a width of ⅝ inch is sufficient to accommodate the joined flanges 15, 15' having an overall flange thickness of ½ inch. The groove 20 may have a depth of about ¾ inch. In general, a gap of about 1/16 inch between the metal and stone elements is sufficient for forming an epoxy bond joint and for accommodating differing thermal expansion coefficients between the metal and stone elements. The joints between the metal panels 14, 14' and the stone also preferably have a silicone caulking bead 28 applied therealong to provide an attractive appearance and to prevent water from seeping into the epoxy joints.

Figure 5:
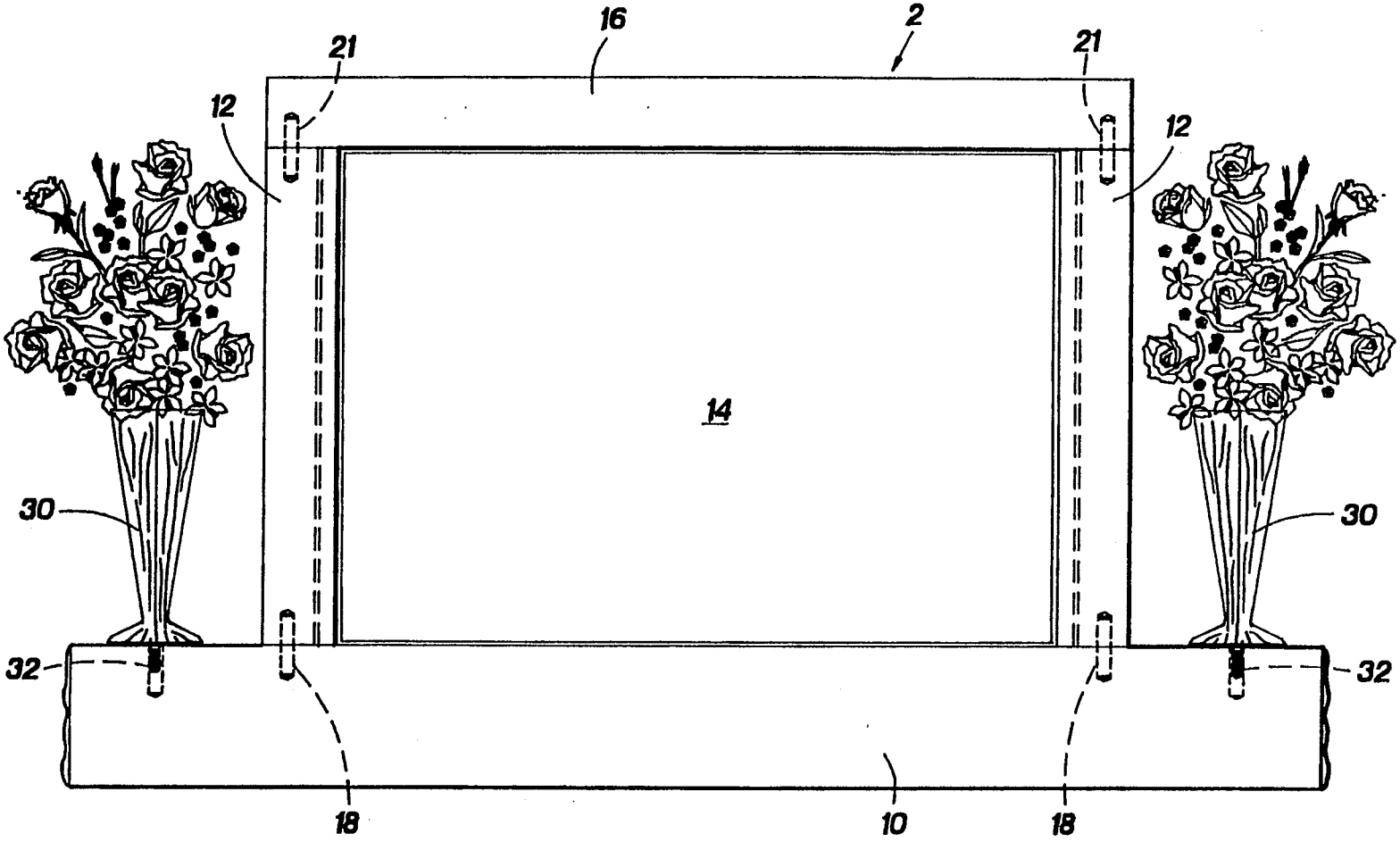
FIG. 5 is a front elevation view of a grave monument of the invention, including a container for holding flowers secured to the base of the monument.
Figure 7:
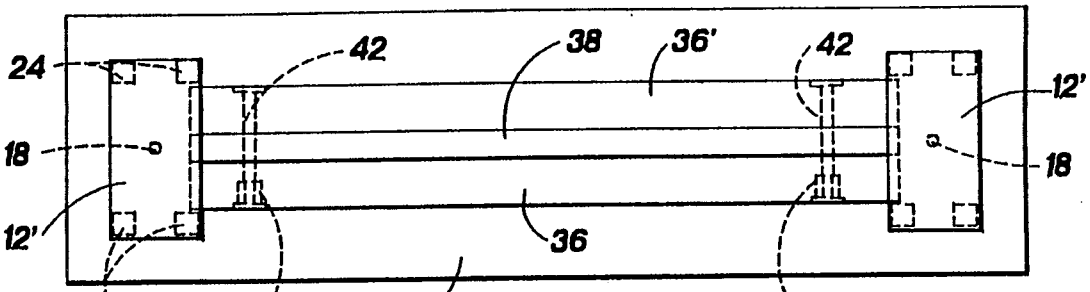
FIG. 7 is a top plan view of the monument of FIG. 6.

Referring to FIG. 5, the monument 2 of the invention may also include one or more containers 30 secured to the base 10 thereof. The containers may be in the form of decorative flower vases, as shown, or may also comprise a memorial candle holder, for example. The containers 30 are conveniently attached to the base 10 by way of a threaded stud 32 which is secured within a predrilled hole formed in the base 10. Various design styles for the containers 30 may, of course, be employed. For example, the sylvan style vase as shown in FIG. 5 is one presently preferred design style. The containers 30 may be cast from bronze or aluminum or otherwise formed from plastic, glass or stone.

Figure 8:
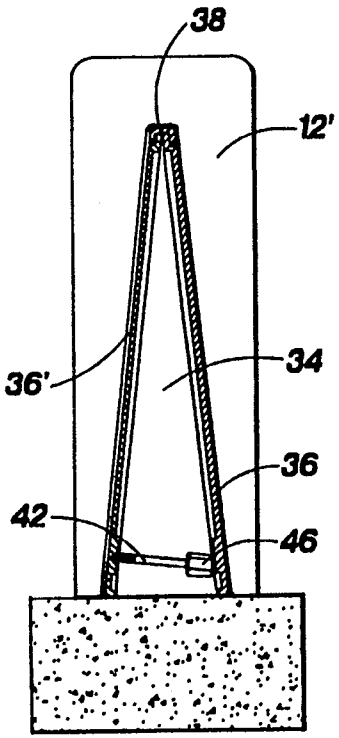
FIG. 8 is a cross sectional side view of the monument taken along line VIII—VIII of FIG. 6.
Figure 9:
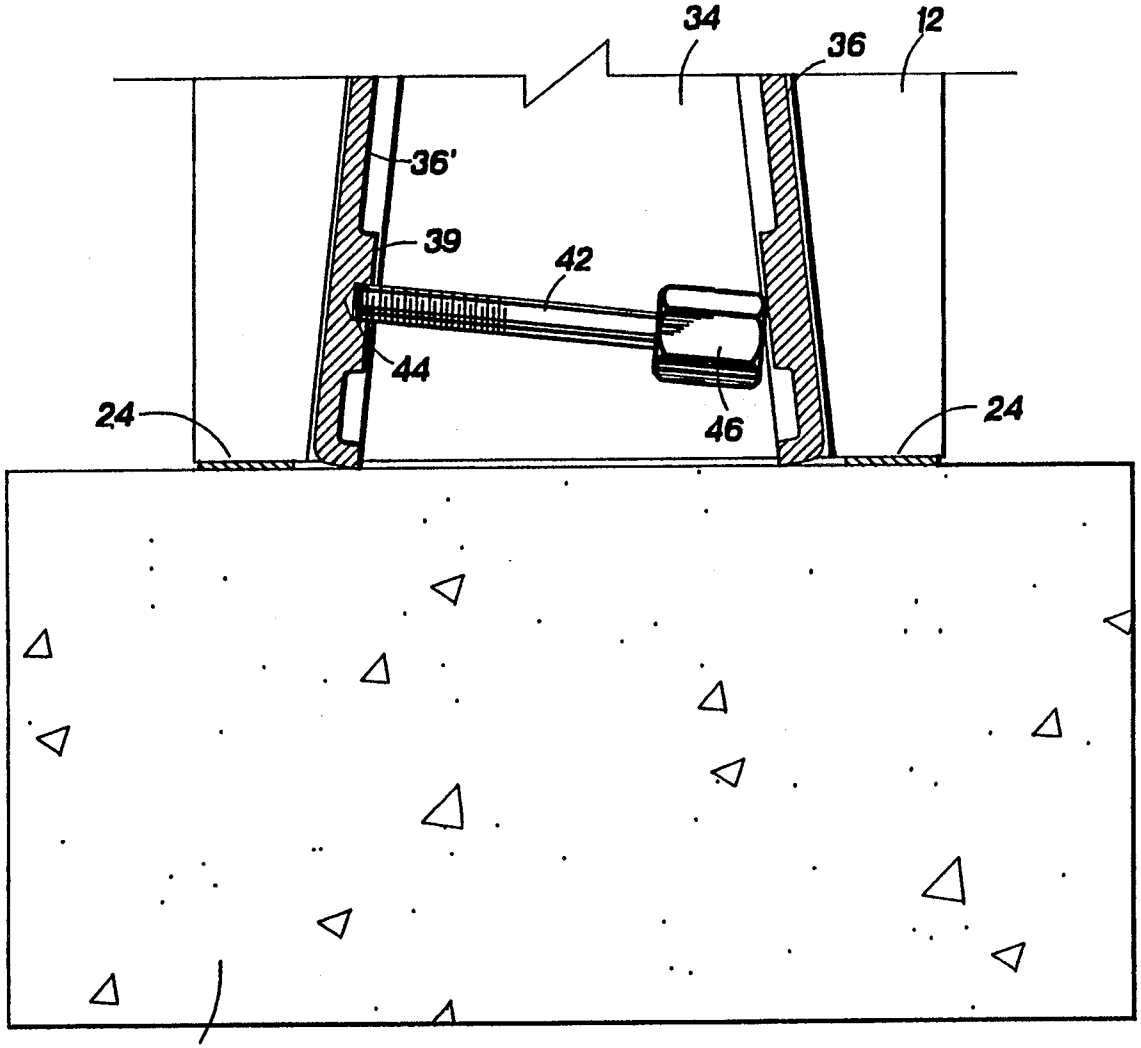
FIG. 9 is an enlarged, partially fragmented, sectional view of a lower portion of the monument depicted in FIG. 8.
Figure 10:
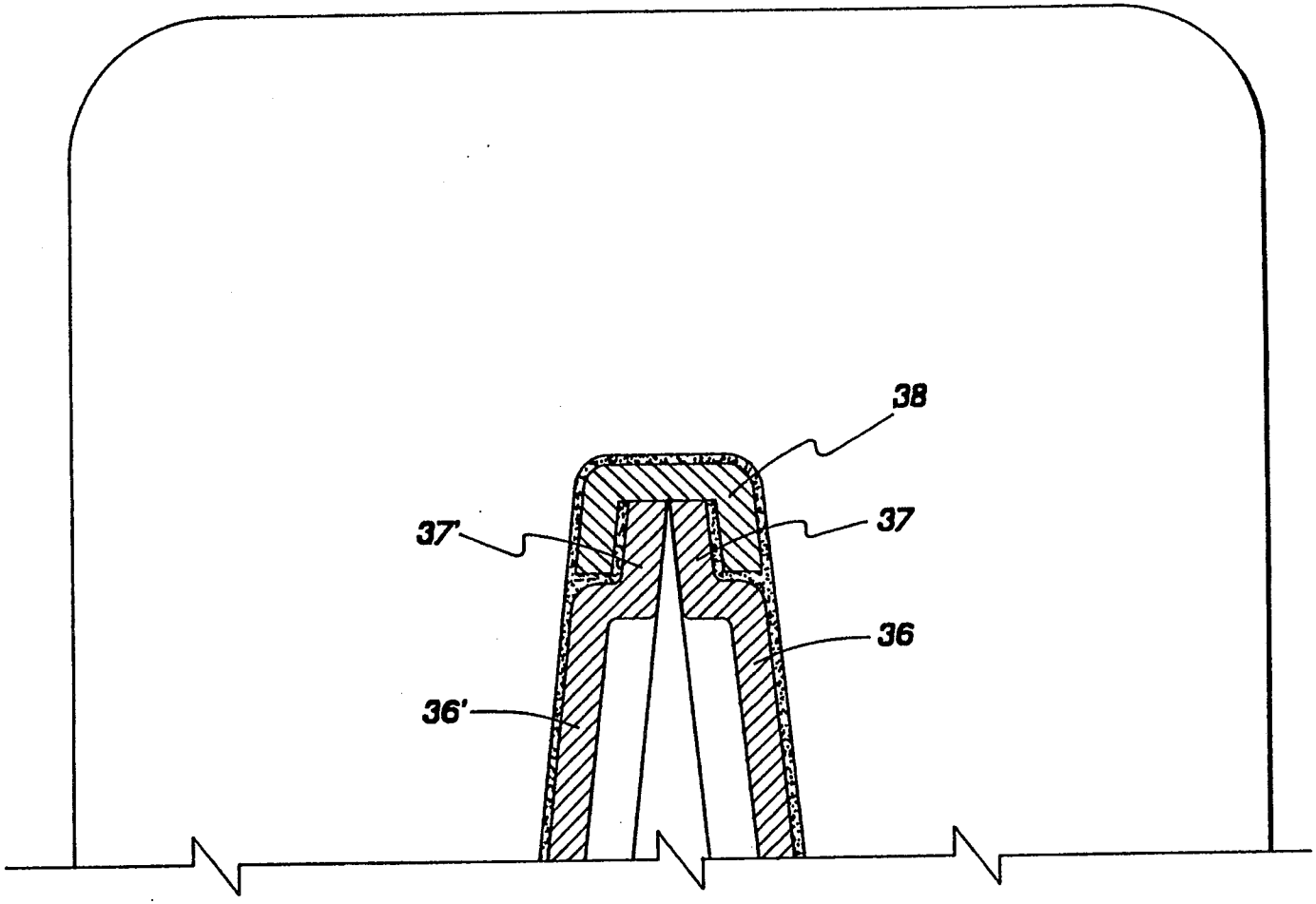
FIG. 10 is an enlarged, partially fragmented, sectional view of an upper portion of the monument depicted in FIG. 8.
Figure 12:
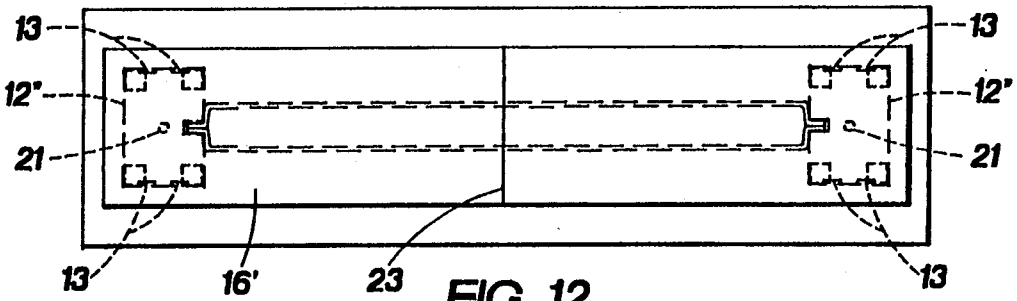
FIG. 12 is a top plan view of the monument of FIG. 11.

A further, presently preferred embodiment of the present invention is depicted in FIGS. 6–9. The monument generally designated 2', depicted in FIGS. 6–9, contains no stone top member 16 as in the previously described embodiment. In addition, the metal panels 36, 36' of monument 2' are not parallel but, rather, assume a triangular relationship or "A"-shaped profile when viewed in side cross section In the monument 2' a pair of vertically extending, spaced-apart posts 12' are secured to a horizontally extending base member 10'. The posts and base are made of stone, preferably granite. The stone posts 12' have a cutout area 34 formed therein to receive the lateral edges of a pair of metal panels 36, 36' therein. The metal panels are cast from bronze or aluminum, preferably bronze. The cutout or recessed area 34 formed in each of the posts 12' has a depth of about ½ inch and assumes a generally triangular or "A" shape, as shown in FIG. 8. The cutout area 34 has a width of about 6 inches, for example, at the base of the posts 12' and converges to an apex near a top portion of each post. The upper edges of the panels 36, 36' are joined together by an elongated, U-shaped channel or metal cap 38, of bronze or aluminum, which extends horizontally between the posts 12'. As shown in FIG. 10, the upper edges of the respective metal panels 36, 36' carry offset flanges 37, 37' to provide a seating area for the cap 38. The cap 38, in addition to providing a decorative appearance, also engages the sides of the flanges 37, 37' and prevents the upper edges of metal panels 36, 36' from bowing or otherwise separating due to thermal expansion. Epoxy is also applied between the flanges 37, 37' and the interior of the cap 38 to provide a secure joint therebetween. Epoxy is also applied along the interface between the cutout area 34 of the granite post 12' and the lateral edges of the panels 36, 36'. In addition, a silicone caulking bead 28 is applied along the interface between the bronze panels 36, 36' and the vertical posts 12' to prevent water leakage into the epoxy joints and cutout area 34.

Figure 6:
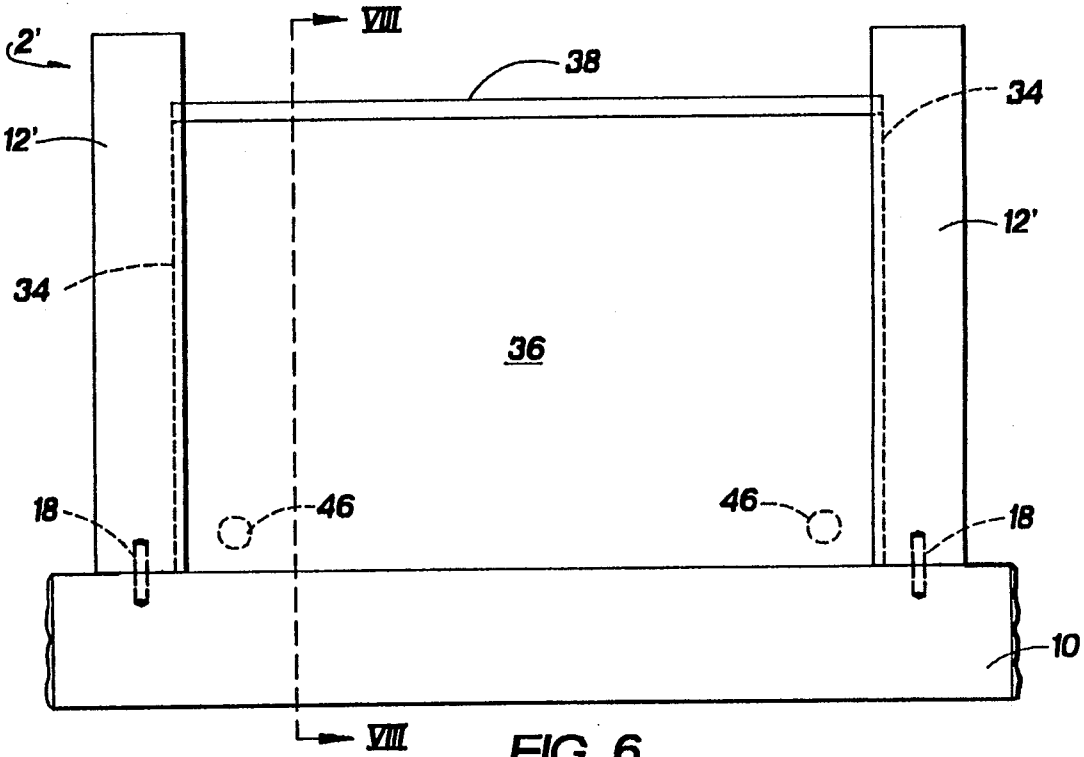
FIG. 6 is a front elevation view of a further preferred embodiment of a grave monument of the present invention.

The "A"-shape metal panels 36, 36' are disposed at an angular relationship of between about 10°–15°, and preferably about 12°. As seen in FIG. 9, the spacing and resultant angular relationship between the metal panels 36, 36' is established by a pair of spaced-apart, threaded studs 42. Each stud 42 is threadably secured within a threaded bore 44 formed on an interior side wall of the panel 36'. The bronze panel 36' carries a thicker web portion 39 formed in the side wall thereof which provides additional depth for formation of the threaded bore 44 therein. The distal end of each of the studs 42 carries a moveable spacer nut 46. The pair of spacer nuts 46, as depicted in FIG. 6, are positioned adjacent each of the posts 12' near the bottom of the panels 36, 36'. The nuts 46 are rotated to move along the studs 42 to bear against the opposite panel 36. Further rotation of the nuts 46 pushes the panels outwardly to a position where the panels 36, 36' conform with the "A"-shape profile of the cutout recess 34. Further outward movement of the panels is prevented by the edges of the recess 34, while inward movement of the panels is prevented by the studs 42 and nuts 46.

As seen in FIG. 9, spacer elements 24 of a thin plastic material, as previously described, are also employed to provide a gap between the bottom of each of the posts 12' and the base 10' for the purposes of creating a space for the epoxy joint.

Figure 11:
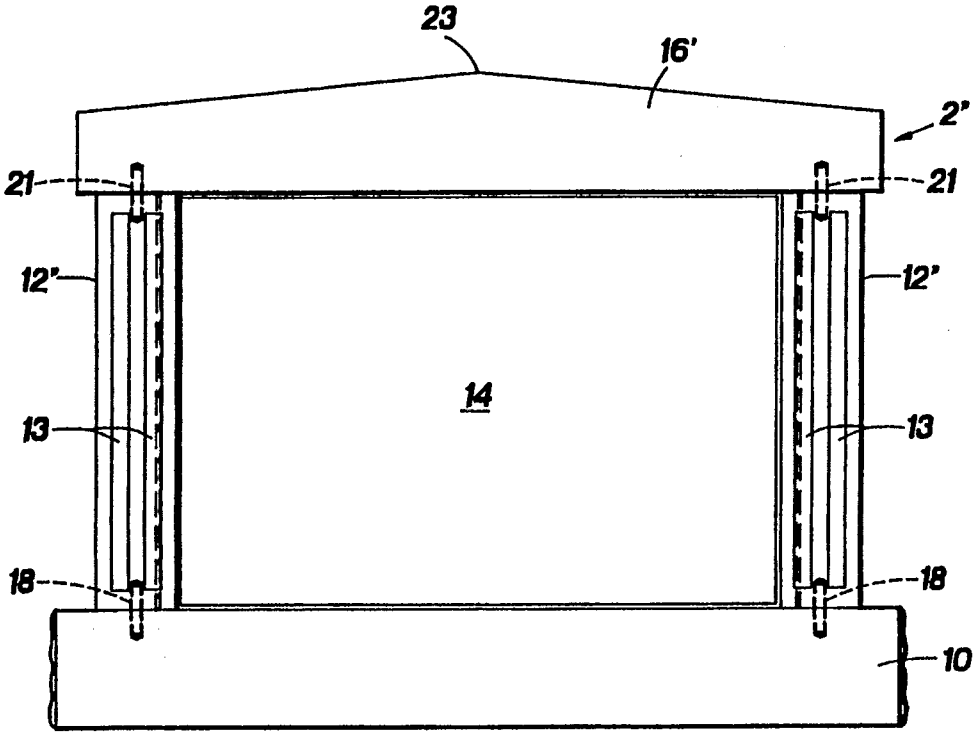
FIG. 11 is a front elevation view of a grave monument of the invention having decorative grooves on the vertical posts and a top stone member of modified shape.

A still further presently preferred embodiment of the invention is depicted in FIG. 11 wherein the monument 2'' is fashioned in a classical Grecian design. The vertical posts 12'' have pairs of decorative grooves 13 formed vertically along the front and back faces thereof. The grooves 13 may be cut by conventional sand blasting The stone base 10'' preferably of granite, is rectangularly shaped, substantially as in the previously described embodiments The top stone member 16' also preferably of granite, has a raised apex 23 at its midpoint to provide a pleasing design appearance.

By way of example, a typical granite base 10 for the monument 2, 2', 2'' to memorialize a double grave may be on the order of about 3 ½ feet long by 1 foot wide and 6 inches high. The granite posts 12 may be spaced apart about 2 ½ feet. The posts 12 are typically 6 inches wide by 3 inches thick and approximately 1 foot 9 inches high. The posts 12' have a slightly wider dimension of about 8 inches to accommodate the diverging array of the bronze panels 36, 36'. The granite base 10 of the monument 2 in FIG. 5 is made slightly longer, on the order of about 4 feet 4 inches long, to accommodate the containers 30. The stone and metal upright monuments 2, 2', 2'' of the invention may also be shortened in length about 1 foot when only a single grave is to be memorialized. The aforementioned dimensions are given merely as an example and are not intended to be limiting in any way.

It will be appreciated that the weight savings provided by the instant invention is significant when a granite monument of a similar size is compared therewith. In this regard, a weight savings on the order of several hundred pounds may be obtained when utilizing the present invention.

Figure 14:
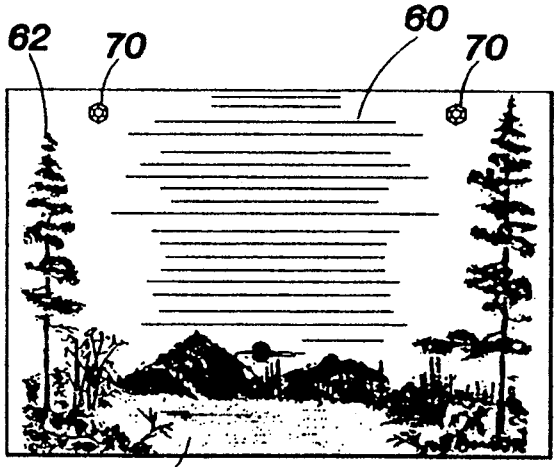
FIG. 14 is a rear elevation view of a back metal panel for use in the monument of FIG. 13.
Figure 13:
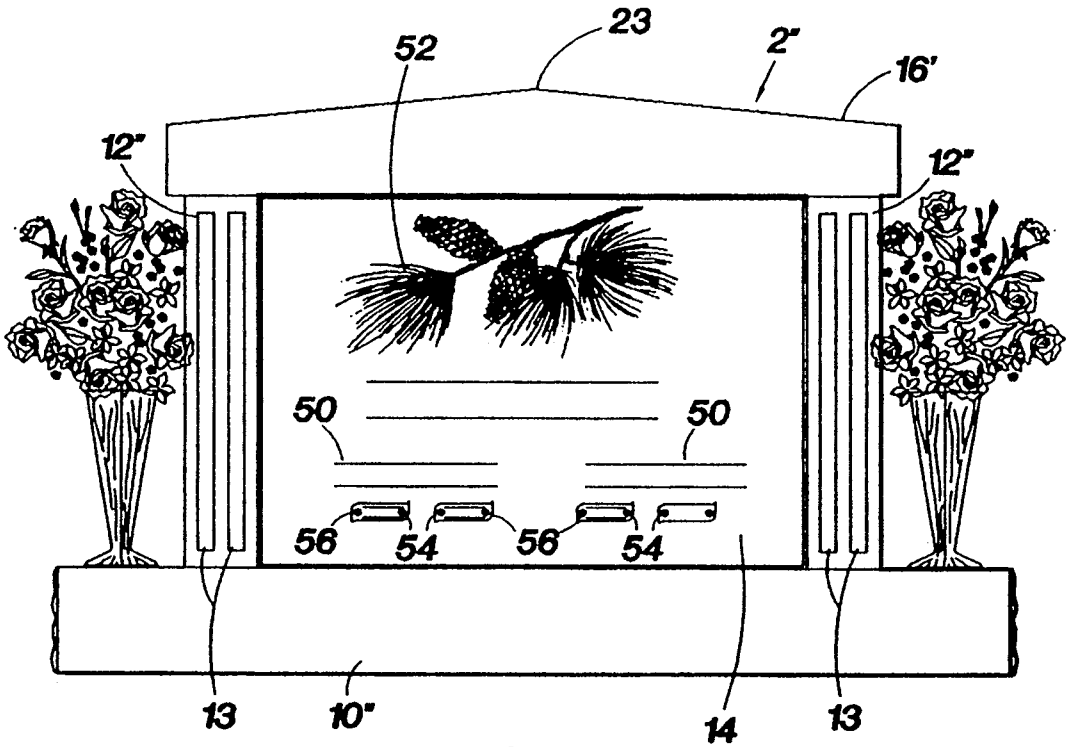
FIG. 13 is a front elevation view of a grave monument of the invention depicting indicia relating to the deceased on a front metal panel thereof.

The panels 14, 14' and 36, 36' are preferably cast from one of bronze or aluminum metal and bear indicia thereon to identify and memorialize the decedent. Presently, bronze is the preferred metal. The name or names of the deceased and dates of birth and death may be cast directly into one of the bronze panels or the indicia may be added separately by using appropriate fasteners or adhesive, as discussed in greater detail hereinafter. The use of two metal panels 14, 14' as shown in FIGS. 13 and 14, permits the utilization of separately cast or otherwise formed indicia on one or both of the panels. A front bronze panel 14, for example, may have name indicia 50 as well as a decorative design such as a pine bough 52 formed directly therein at the time the panel is cast. Other memorial information, such as the dates of birth and death of the deceased, may be formed at the time of casting or it may be added by separate bronze overlay scroll plates 54 secured to the panel 14 by brass screw fasteners 56, for example.

The rear bronze panel 14' as shown in FIG. 14, may contain one of several standardized epitaph verses 60 and/or decorative designs 62 cast therein. Thus, the front panel 14 or memorial panel is formed in a customized manner with the memorial indicia 50 pertaining to the particular deceased person or persons cast therein, while the rear panel 14' or epitaph panel may be blank or it may have one of several standard epitaph verses 60 cast therein. Of course, both the front and rear panels may be custom cast, if desired, to carry the personalized epitaph of the deceased on the rear panel, for example. As previously stated, when the bronze panels 14, 14' or 36, 36' are joined together in the upright monument of the invention, they appear as a monolithic casting of considerable thickness. While a single metal panel could be employed, it does not provide the features of the two-panel embodiments. A single metal panel cannot carry cast indicia on its front and back surfaces nor does it provide the thick appearance of the double panel embodiments.

The metal panels 14, 14' and 36, 36' may also have one or more cutout portions formed therein for placement of opaque or transparent colored glass inserts therein for an additional decorative effect. A multifaceted, cut glass, jewel-like insert 70 may be employed, for example, as shown in FIG. 14. The granite used in the base 10 and posts 12 may be selected in various colors and textures, such as black, blue, rose or pink, for example. In addition, the granite surfaces may be finished in a variety of ways such as polished or rustic. Thus, the granite elements are selectively chosen to enhance the beauty of the bronze panels in a most pleasing manner.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

I claim:

1. An upright monument for the deceased comprising:

a stone base;

a pair of spaced-apart vertical stone posts attached to the base; and metal panel means having indicia of the deceased thereon mounted between the vertical posts wherein the metal panel means comprises a pair of metal panels, each of said metal panels having a pair of outwardly extending, offset flanges on opposed lateral sides, and wherein said post members have vertically extending grooves to receive said flanges therein.

2. The monument of claim 1 wherein the metal panels are cast from a metal selected from the group consisting of bronze and aluminum and wherein one of said metal panels carries identifying memorial indicia relating to a deceased person cast therein and the other of said panels carries epitaph indicia cast therein.

3. The monument of claim 1 including a top stone member horizontally extending above the metal panel means and attached to the vertical posts.

4. The monument of claim 1 further including at least one container means secured to the base.

5. The monument of claim 3 wherein the container means is a vase.

6. The monument of claim 1 wherein each of said posts is attached to the base by at least one steel pin positioned in aligned holes formed in the post and in the base and including epoxy resin placed around said pin and between the post and the base and further including a plurality of spacer elements positioned between the posts and the base to provide a gap for forming an epoxy joint between the posts and the base.

7. The monument of claim 1 wherein a bead of silicone caulking is positioned between the vertical posts and said metal panel means to prevent water infiltration therein.

8. An upright grave monument comprising:

a granite base;

a pair of spaced-apart vertical granite posts attached to said base, each of said posts having a vertical groove formed on a respective inside facing surface thereof;

a pair of bronze panels having vertically extending, offset lateral flanges thereon, said flanges fitted within a respective vertical groove in the posts; and a horizontally extending granite top member attached to upper surfaces of said posts.

9. The monument of claim 8 each of said posts further has a plurality of vertically extending decorative grooves formed on front and rear surfaces thereof.

10. The monument of claim 8 wherein the pair of metal panels carries identifying memorial indicia relating to a deceased person cast therein and the other of said panels carries epitaph indicia cast therein.

11. The monument of claim 8 further including at least one container means secured to the base.

12. An upright grave monument comprising:

a granite base;

a pair of spaced-apart vertical granite posts attached to said base, each of said posts having a recessed cutout area formed in inside facing surfaces thereof;

a pair of bronze panels engaged along upper edge portions and diverging outwardly therefrom to the base, said bronze panels having lateral edges fitted within the recessed cutout area of the posts; and an elongated bronze cap horizontally extending between the posts and attached to the bronze panels along the top edges thereof.

13. The monument of claim 12 wherein one of said metal panels carries identifying memorial indicia relating to a deceased person cast therein and the other of said panels carries epitaph indicia cast therein.

14. The monument of claim 12 including at least one flower vase attached to the base.

15. The monument of claim 12 wherein the bronze cap is attached to the bronze panels by epoxy resin.

16. The monument of claim 12 including at least one spacer means positioned between the two panels to maintain a divergent orientation between the panels.

17. The monument of claim 16 wherein the spacer means is a threaded stud secured to an inner surface of a first of said bronze panels and coupling nut moveably positioned on the stud to engage an inner surface of a second of said bronze panels.

18. The monument of claim 12 wherein the pair of bronze panels diverges at an angle between about 10° to 15°.

19. The monument of claim 18 wherein the angle is about 12°.

* * * * *

UNITED STATES PATENT AND TRADEMARK OFFICE

CERTIFICATE OF CORRECTION

PATENT NO. : 5,363,609

DATED : November 15, 1994

INVENTOR(S) : John P. Hancovsky

It is certified that error appears in the above-indentified patent and that said Letters Patent is hereby corrected as shown below:

Title page, item [56], under References Cited, U.S. PATENT DOCUMENTS, "1,843,602 2/1936 Holmes ... 52/103" should read --1,843,602 2/1932 Holmes ... 52/103--.

Column 4 Line 68 after "section" insert --.--.

Column 5 Line 68 after "embodiments" insert --.--.

Claim 9 Line 15 Column 8 after "8" insert --wherein--.

Signed and Sealed this

Tenth Day of January, 1995

*Attest:*

Bruce Lehman

BRUCE LEHMAN

*Attesting Officer*

*Commissioner of Patents and Trademarks*